US009126071B2

(12) United States Patent
Smith

(10) Patent No.: US 9,126,071 B2
(45) Date of Patent: Sep. 8, 2015

(54) CABLE END ASSEMBLIES FOR EXERCISE MACHINES, EXERCISE MACHINES INCLUDING SUCH CABLE END ASSEMBLIES, AND RELATED METHODS

(71) Applicant: ICON Health & Fitness, Inc., Logan, UT (US)

(72) Inventor: Kent M. Smith, Nibley, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 120 days.

(21) Appl. No.: 14/048,021

(22) Filed: Oct. 7, 2013

(65) Prior Publication Data

US 2014/0135181 A1 May 15, 2014

Related U.S. Application Data

(60) Provisional application No. 61/710,560, filed on Oct. 5, 2012.

(51) Int. Cl.
*A63B 21/062* (2006.01)
*A63B 21/00* (2006.01)

(52) U.S. Cl.
CPC ..... *A63B 21/0001* (2013.07); *A63B 21/062* (2013.01)

(58) Field of Classification Search
CPC ..... A63B 21/00003; A63B 21/00007; A63B 21/0001; A63B 21/062; A63B 21/0623; A63B 21/15; A63B 21/151; A63B 21/152
See application file for complete search history.

(56) References Cited

U.S. PATENT DOCUMENTS

| | | | | |
|---|---|---|---|---|
| 2,573,351 | A * | 10/1951 | Motis | 623/64 |
| 3,194,598 | A * | 7/1965 | Goldfuss | 294/82.19 |
| 4,887,929 | A | 12/1989 | Hale | |
| 5,669,455 | A | 9/1997 | Dietrich | |
| 6,510,760 | B2 | 1/2003 | Matsuo | |
| 6,695,620 | B1 | 2/2004 | Huang | |
| 7,341,545 | B2 | 3/2008 | Cao | |
| 7,749,140 | B1 * | 7/2010 | Lindemeier et al. | 482/82 |
| 8,215,886 | B2 | 7/2012 | Campbell et al. | |
| 8,591,386 | B2 * | 11/2013 | Meyer | 482/99 |

* cited by examiner

*Primary Examiner* — Oren Ginsberg
(74) *Attorney, Agent, or Firm* — Holland & Hart LLP

(57) ABSTRACT

A cable end assembly for an exercise machine may comprise a coupler assembly, a cable end, and an eye hook. The coupler assembly may comprise a first coupler connected to a second coupler. The cable end may have a fitting attached to an end, the fitting having an enlarged portion. The enlarged portion of the fitting may be retained within a recess of the first coupler. Additionally, the eye hook may be rotatably coupled to the second coupler. A method of manufacturing a cable end assembly for an exercise machine may comprise attaching a fitting having an enlarged portion to an end of a cable. The method may further comprise inserting the fitting into a recess of a first coupler, rotatably coupling an eye hook to a second coupler, and connecting the first coupler to the second coupler.

20 Claims, 6 Drawing Sheets

CABLE END ASSEMBLIES FOR EXERCISE MACHINES, EXERCISE MACHINES INCLUDING SUCH CABLE END ASSEMBLIES, AND RELATED METHODS

CROSS-REFERENCE TO RELATED APPLICATION

This application claims priority to U.S. Provisional Patent Application 61/710,560 filed on Oct. 5, 2013.

TECHNICAL FIELD

Embodiments of the present disclosure relate generally to weight bearing cables for exercise machines. More specifically, embodiments of the present disclosure relate to cable end assemblies, exercise machines including such cable end assemblies, and related methods.

BACKGROUND

Many exercise machines include one or more cables that are coupled to an adjustable weight source, such as a stack of weights. Another end of the cable may be coupled to a component with which a user engages with to exercise, such as a handle. Accordingly, the cable may provide resistance force to a user during exercise by transferring force from the adjustable weight source. Typically, to attach an end of the cable to another component of the exercise machine a loop is made in the cable and a sleeve is crimped over the free end and the adjacent portion of cable.

Significant static and dynamic weight loads may be utilized while exercising. Accordingly, the cable may repeatedly carry large loads. While cables utilized in exercise machines may be sized to handle these loading conditions, often the crimped sleeve will fail at a load below which the cable would be expected to fail. Such a failure may render the exercise machine useless for its intended purpose.

U.S. Pat. No. 7,341,545 to Cao teaches a torque releasing mechanism for fitness equipment. The torque releasing mechanism is an attachment to a handle bar, thus allowing the handle bar to rotate relative to the cable. While this solves a problem of built up torque being imparted on the cable by the handle bar, and the problem of such torque causing the handle bar to unexpectedly rotate, the invention of Cao does not teach an improved method or device for terminating the cable and attaching the cable to the torque releasing mechanism. Accordingly, an exercise machine utilizing the torque releasing mechanism of Cao would still rely on a conventional cable end connection, which may be unreliable.

In view of the foregoing, improved cable end assemblies for exercise machines would be desirable.

SUMMARY

One aspect of the disclosure relates to a cable end assembly for an exercise machine, which may comprise a coupler assembly, a cable end, and an eye hook.

In an additional aspect of the disclosure, which may be combined with any other aspect herein, the coupler assembly may comprise a first coupler connected to a second coupler.

In an additional aspect of the disclosure, which may be combined with any other aspect herein, the cable end may have a fitting attached to an end, the fitting having an enlarged portion with a cross-sectional size larger than a cross-sectional size of the cable end.

In an additional aspect of the disclosure, which may be combined with any other aspect herein, the enlarged portion of the fitting may be retained within a recess of the first coupler.

In an additional aspect of the disclosure, which may be combined with any other aspect herein, the eye hook may be rotatably coupled to the second coupler.

In an additional aspect of the disclosure, which may be combined with other aspects of the disclosure, the fitting may be attached to the end of the cable end by a swaged region.

In an additional aspect of the disclosure, which may be combined with any other aspect herein, the cable end assembly may further comprise a pin inserted through an aperture of the first coupler and an aperture of the second coupler to lock the first coupler to the second coupler.

In an additional aspect of the disclosure, which may be combined with any other aspect herein, the pin may comprise a spring pin.

In an additional aspect of the disclosure, which may be combined with any other aspect herein, the cable end assembly may further comprise a nut threaded to an end of the eye hook to retain the end of the eye hook within the second coupler.

In an additional aspect of the disclosure, which may be combined with any other aspect herein, the nut may comprise a lock nut.

In an additional aspect of the disclosure, which may be combined with any other aspect herein, the cable end assembly may further comprise an annular spacer positioned between the nut and the second coupler.

In an additional aspect of the disclosure, which may be combined with any other aspect herein, the second coupler may comprise two openings positioned and configured to facilitate the insertion of a tool to selectively allow or prevent the nut from rotating relative to the second coupler.

In an additional aspect of the disclosure, which may be combined with any other aspect herein, the first coupler may comprise a protrusion sized and configured to fit within a recess of the second coupler.

In an additional aspect of the disclosure, which may be combined with any other aspect herein, the first coupler may comprise a central aperture having a first longitudinal region and a second longitudinal region, the first longitudinal region may have a diameter that is larger than the cross-sectional size of the enlarged portion of the fitting attached to the end of the cable and the second longitudinal region may have a diameter that is smaller than the cross-sectional size of the enlarged portion of the fitting.

In an additional aspect of the disclosure, which may be combined with any other aspect herein, the first coupler may further comprise a slot extending to the central aperture, the slot may have a width that is wider than the width of the cable and narrower than the than the cross-sectional size of the enlarged portion of the fitting attached to the end of the cable.

In an additional aspect of the disclosure, which may be combined with any other aspect herein, the cable end assembly may further comprise a handle coupled to the eye hook.

In an additional aspect of the disclosure, which may be combined with any other aspect herein, the cable end assembly may further comprise a weight stack assembly coupled to the eye hook.

Another aspect of the disclosure relates to a method of manufacturing a cable end assembly for an exercise machine.

In an additional aspect of the disclosure, which may be combined with any other aspect herein, the method may comprise attaching a fitting having an enlarged portion with a cross-sectional size larger than a cross-sectional size of the cable to an end of a cable.

In an additional aspect of the disclosure, which may be combined with any other aspect herein, the method may comprise inserting the fitting into a recess of a first coupler.

In an additional aspect of the disclosure, which may be combined with any other aspect herein, the method may comprise rotatably coupling an eye hook to a second coupler.

In an additional aspect of the disclosure, which may be combined with any other aspect herein, the method may comprise connecting the first coupler to the second coupler.

In an additional aspect of the disclosure, which may be combined with any other aspect herein, rotatably coupling the eye hook to the second coupler may comprise inserting an end of the eye hook through an aperture and threading a nut onto the end of the eye hook.

In an additional aspect of the disclosure, which may be combined with any other aspect herein, the method may further comprise positioning a spacer within the second coupler between the nut and the second coupler.

In an additional aspect of the disclosure, which may be combined with any other aspect herein, threading the nut onto the end of the eye hook may comprise inserting a tool into two openings within the second coupler to prevent the nut from rotating relative to the second coupler and rotating the eye hook relative to the second coupler and the nut.

In an additional aspect of the disclosure, which may be combined with any other aspect herein, connecting the first coupler to the second coupler may comprise inserting a pin through an aperture in the first coupler and through an aperture in the second coupler.

In an additional aspect of the disclosure, which may be combined with any other aspect herein, attaching the fitting to the end of the cable may comprise swaging the fitting to the end of the cable.

A further aspect of the disclosure may relate to an exercise machine comprising a weight stack, a cable connected to the weight stack, and a cable end assembly.

In an additional aspect of the disclosure, which may be combined with any other aspect herein, the cable end assembly may comprise a coupler assembly comprising a first coupler connected to a second coupler.

In an additional aspect of the disclosure, which may be combined with any other aspect herein, the cable end assembly may comprise a fitting attached to an end of the cable, the fitting having an enlarged portion with a cross-sectional size larger than a cross-sectional size of the cable.

In an additional aspect of the disclosure, which may be combined with any other aspect herein, the enlarged portion of the fitting may be retained within a recess of the first coupler.

In an additional aspect of the disclosure, which may be combined with any other aspect herein, the cable end assembly may comprise an eye hook rotatably coupled to the second coupler.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
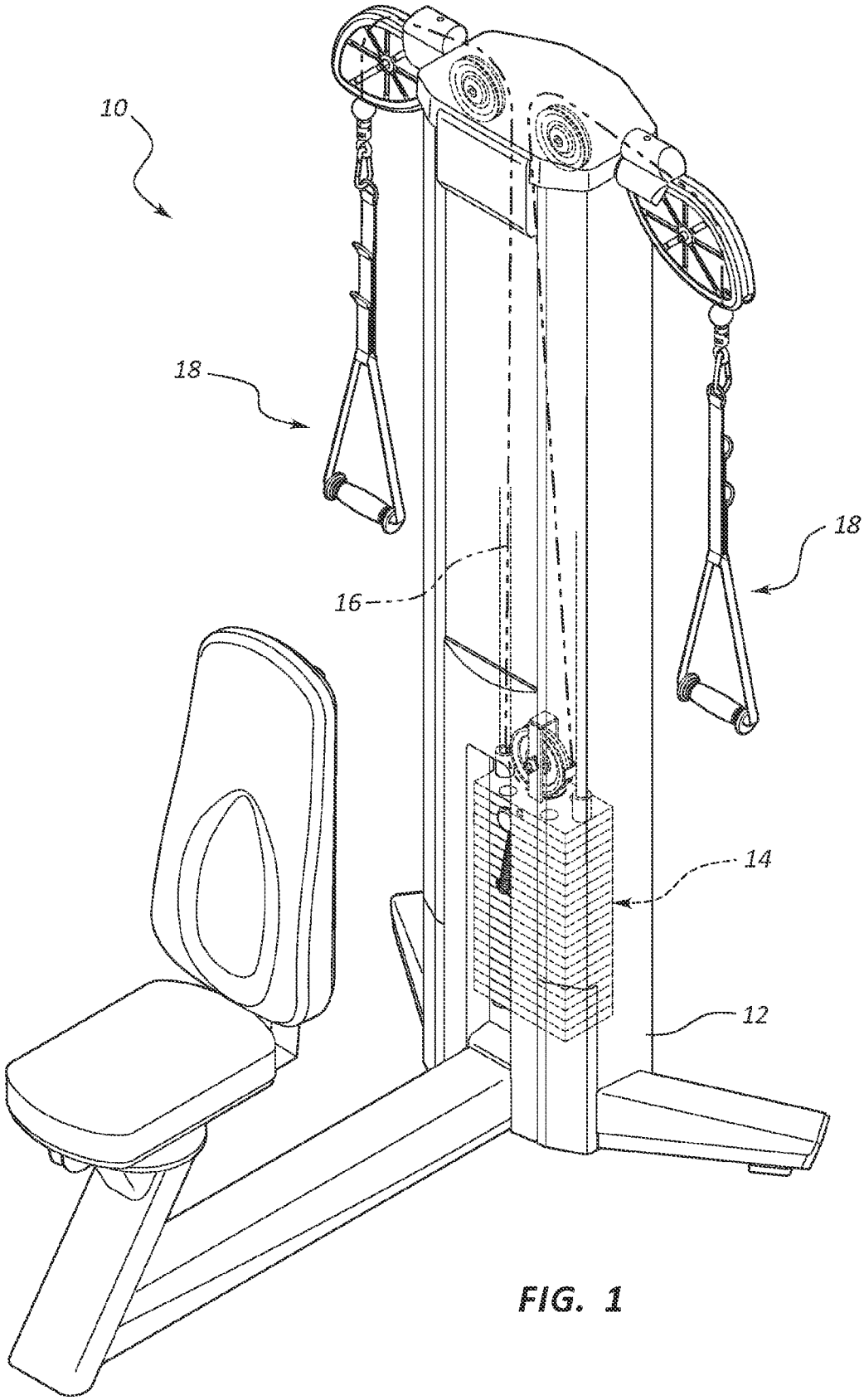
FIG. 1 is an isometric view of an exercise machine including a cable end assembly, according to an embodiment of the present disclosure.

As shown in FIG. 1, an exercise machine 10 may comprise a frame 12, an adjustable weight source, such as a weight stack assembly 14, a cable 16, and one or more components for engagement by a user, such as handles 18. Each end of the cable 16 may be attached to a handle 18 via a cable end assembly 20 and a mid portion of the cable 16 may be attached to the weight stack assembly 14.

Figure 2:
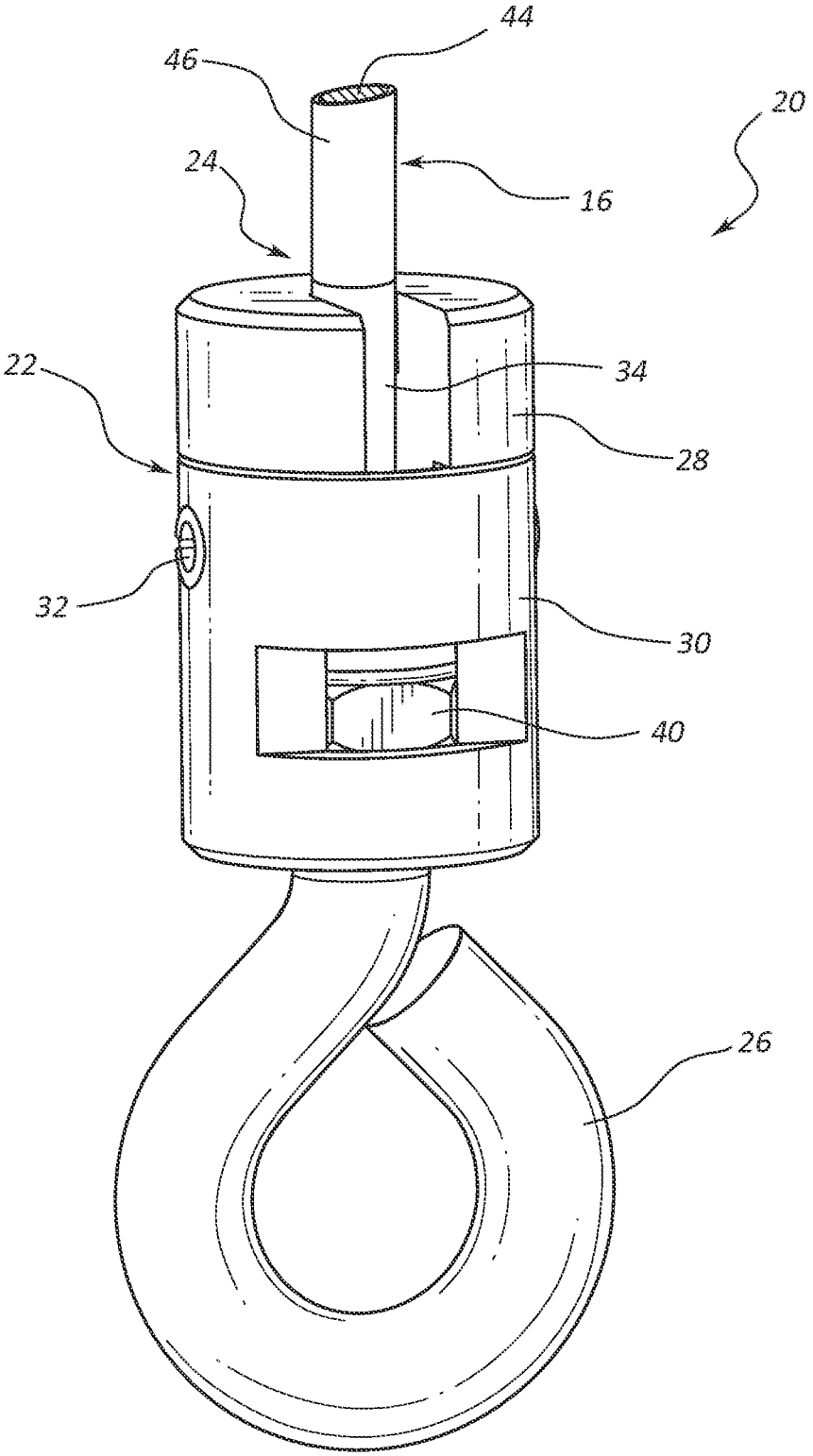
FIG. 2 is an isometric detail view of the cable end assembly of FIG. 1.

Referring now to FIG. 2, the cable end assembly 10 may include a coupler assembly 22, a cable end 24, and an eye hook 26. The coupler assembly 22 may comprise a first coupler 28 connected to a second coupler 30 by a pin 32. The cable end 24 may have a fitting 34 attached thereto, the fitting 34 having an enlarged portion 36 (e.g., a general spherical end portion) with a cross-sectional size larger than a cross-sectional size of the cable 16. The enlarged portion 36 of the fitting 34 may be retained within a recess of the first coupler 28. The eye hook 26 may be rotatably coupled to the second coupler 30 by a nut 40. Additionally, a spacer 42 may be located between the nut 40 and the second coupler 30.

Figure 3:
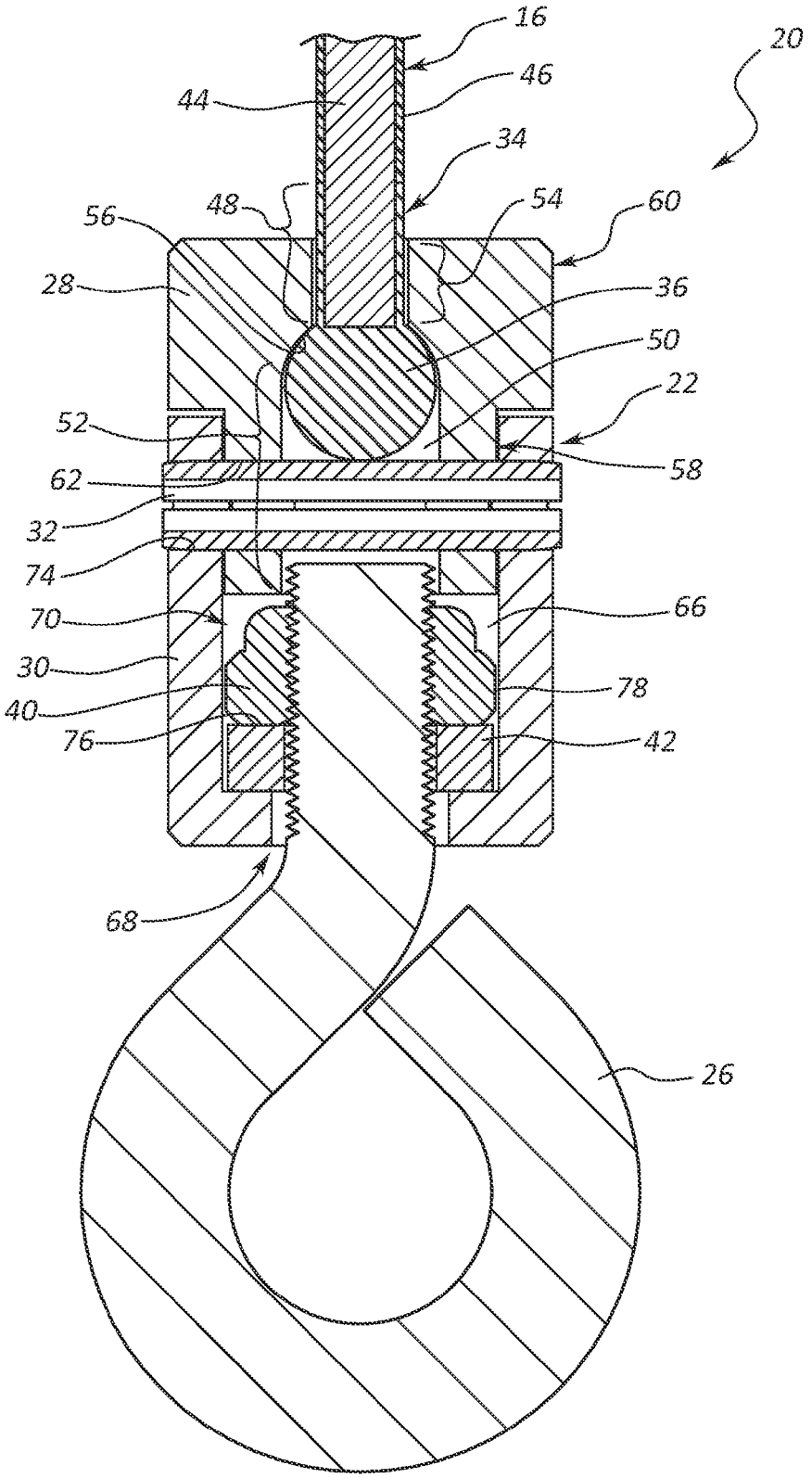
FIG. 3 is a cross-sectional detail view of the cable end assembly of FIG. 1.
Figure 4:
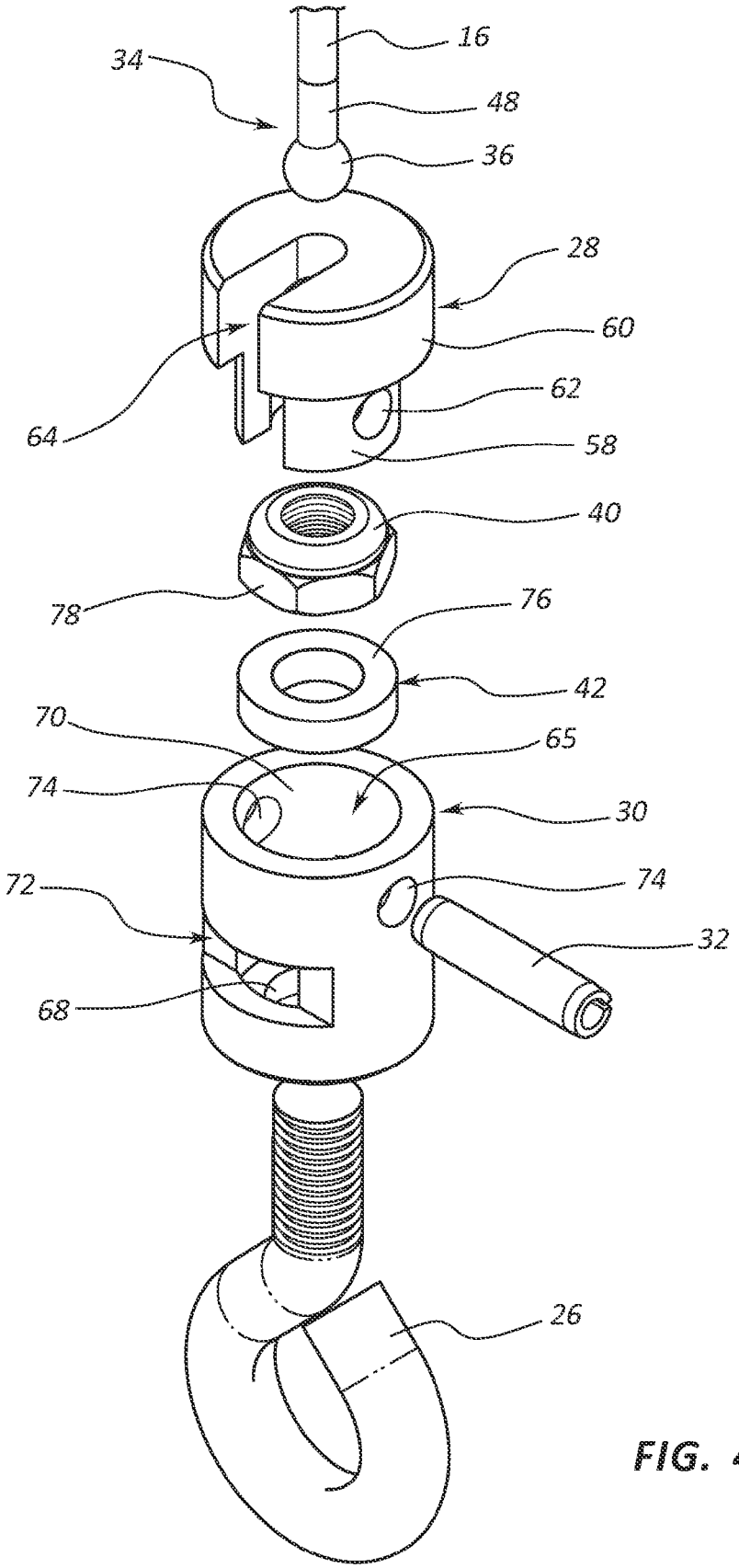
FIG. 4 is an exploded detail view of the cable end assembly of FIG. 1.
Figure 5:
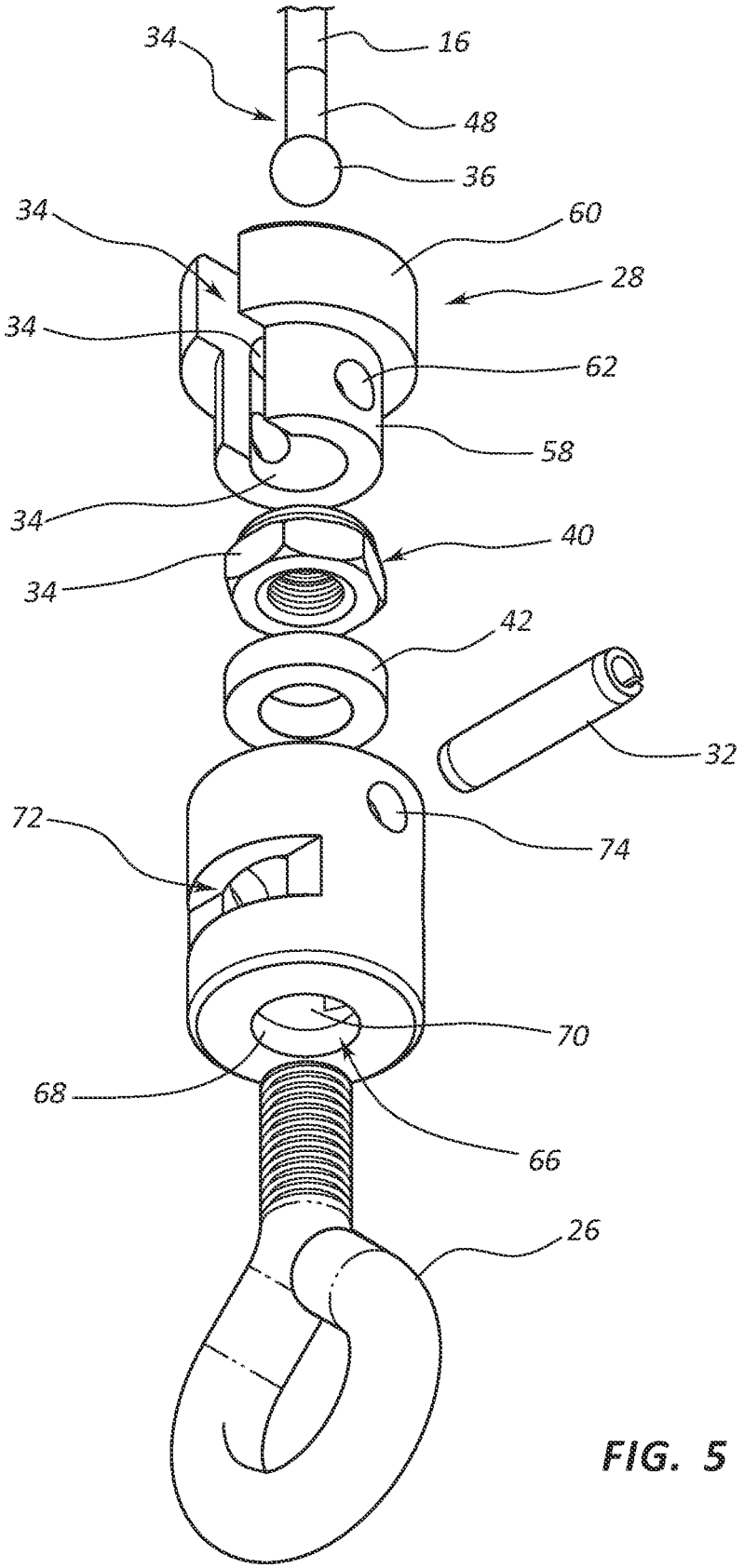
FIG. 5 is an exploded detail view of the cable end assembly of FIG. 1.
Figure 6A:
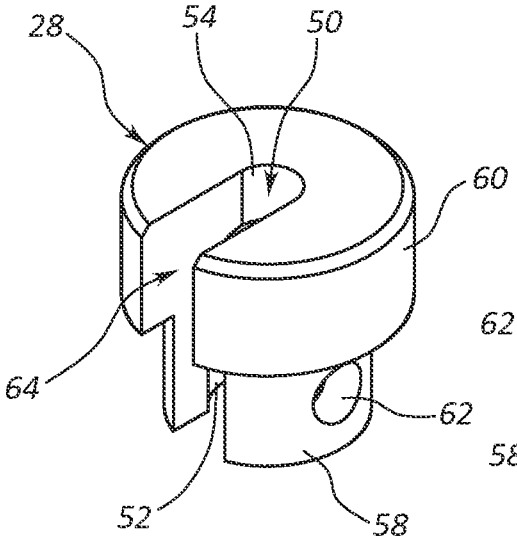
FIG. 6A is an isometric detail view of a first coupler of the coupler assembly of the cable end assembly of FIG. 1.
Figure 6B:
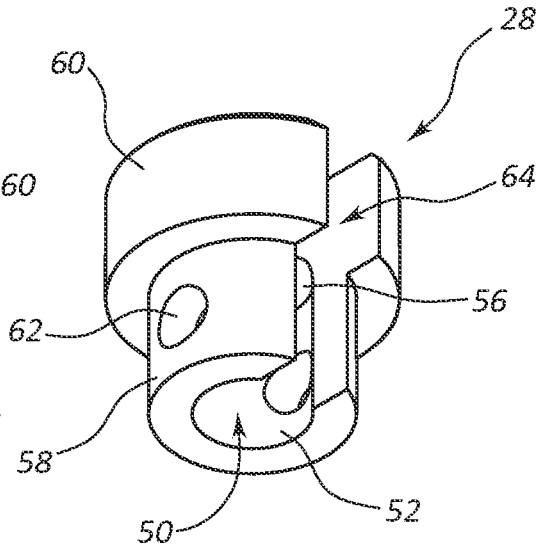
FIG. 6B is an isometric detail view of a first coupler of the coupler assembly of the cable end assembly of FIG. 1.

As shown in FIG. 3, the cable 16 may comprise a braided stainless steel core 44 and a polymer coating 46. A length of the polymer coating 46 at the end of the cable 16 may be removed to facilitate insertion of the end of the cable 16 into an opening of the fitting 34. A region 48 of the fitting 34 adjacent the enlarged end portion 36 may then be swaged by applying external pressure via a swaging die (not shown) and the fitting 34 may be permanently coupled to the end of the cable 16.

As shown in FIGS. 4, 5, 6A, and 6B, the first coupler 28 may comprise a central aperture 50 having a first longitudinal region 52 and a second longitudinal region 54. The first longitudinal region 52 may have a diameter that is larger than the cross-sectional size of the enlarged portion 36 of the fitting 34 attached to the end of the cable 16 and the second longitudinal region 54 may have a diameter that is smaller than the cross-sectional size of the enlarged portion 36 of the fitting 34. A dished shoulder 56 may be defined at the transition between the first longitudinal region 52 and the second longitudinal region 54, the dished shoulder 56 having a shape corresponding to an outer surface of the enlarged portion 36 of the fitting 34.

The first coupler 28 may include a protrusion 58 having an outer diameter that is smaller than the outer diameter of a base portion 60 of the first coupler 28. The first longitudinal region 52 of the central aperture 50 may extend through the protrusion 58, and the second longitudinal region 54 may extend through the base portion 60 of the first coupler 28. Additionally, a laterally extending aperture 62 oriented generally perpendicular to the central aperture 50 may extend through the protrusion 58 of the first coupler 28.

The first coupler 28 may further comprise a slot 64 extending to the central aperture 50, the slot 64 may have a width that is wider than the width of the cable 16 and narrower than the than the cross-sectional size of the enlarged portion 36 of the fitting 34 attached to the end of the cable 16. Accordingly, the cable 16 may be inserted into the central aperture 50 of the first coupler 28 via the slot 64 such that the enlarged portion 36 of the fitting 34 is positioned proximate to the protrusion 58, and thus the first longitudinal region 52 of the central aperture 50. The enlarged portion 36 of the fitting 34 may then be withdrawn into the recess defined by the first longitudinal region 52 and the dished shoulder 56 of the central aperture 50. As the second longitudinal region 54 of the central aperture 50 is sized smaller than the enlarged portion 36 of the fitting 34, the enlarged portion 36 of the fitting 34 may be secured against the dished shoulder 56 and prevented from further movement through the central aperture 50 of the first coupler 28.

Figure 7A:
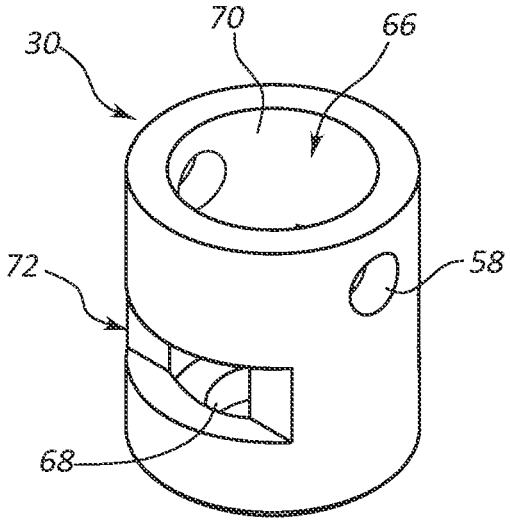
FIG. 7A is an isometric detail view of a second coupler of the coupler assembly of the cable end assembly of FIG. 1.
Figure 7B:
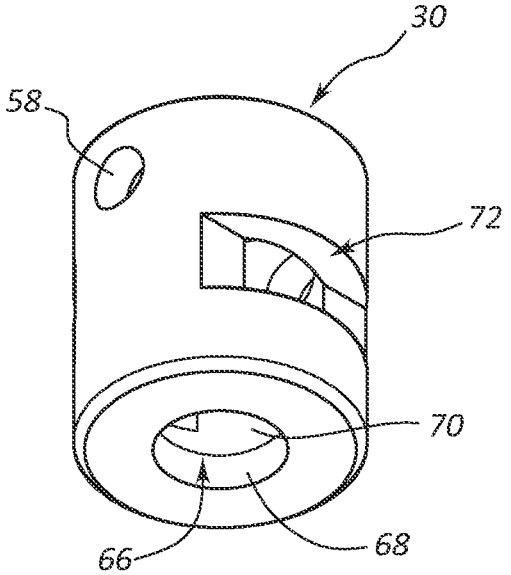
FIG. 7B is an isometric detail view of a second coupler of the coupler assembly of the cable end assembly of FIG. 1.

As shown in FIGS. 7A and 7B, the second coupler 30 may comprise a central aperture 66 comprising an end portion 68 having a diameter larger than an outer diameter of a threaded end of the eye hook and smaller than an outer diameter of the nut. A main portion 70 of the central aperture 66 may be sized to accommodate the nut 40 therein and may be sized to correspond to the outer diameter of the protrusion 58 of the first coupler 28.

Two openings 72 may be machined through an outer wall of the second coupler 30, extending to the main portion 70 of the central aperture 66. The two openings 72 may be positioned and configured to facilitate the insertion of a tool (not shown), such as an open end wrench or pliers, to selectively allow or prevent the nut 40 from rotating relative to the second coupler 30 when the nut 40 is located therein. Additionally, a laterally extending aperture 74 oriented generally perpendicular to the central aperture 66 may extend through the second coupler 30.

Returning again to FIGS. 3-5, the annular spacer 42 may be inserted into the main portion 70 of the central aperture 66 of the second coupler 30 and positioned adjacent to the end portion 68. The annular spacer 42 may be comprised of a polymer material and may be sized such that when positioned within the second coupler 30, adjacent to the end portion 68, a surface 76 of the annular spacer 42 may be located adjacent to each of the two openings 72. The polymer material may be selected so that the surface 76 of the annular spacer 42, which is located between the nut 40 and the end portion 68 of the second coupler 30, may act as a bearing surface, facilitating the rotation of the nut 40 relative to the second coupler 30.

After insertion of the annular spacer 42 into the second coupler 30, the nut 40 may be positioned within the main portion 70 of the central aperture 66 of the second coupler 30, adjacent to the annular spacer 42. A tool, such as an open end wrench or pliers, may be inserted into the two openings 72 in the second coupler 30 adjacent to outer surfaces 78 of the nut 40 to prevent the nut 40 from rotating relative to the second coupler 30. The threaded end of the eye hook 26 may then be inserted through the end portion 68 of the central aperture 66 of the second coupler 30 and threaded into corresponding threads of the nut 40. The nut 40 may be a lock nut, such a nylock nut, and the threaded end of the eye hook 26 may be threaded through the nut 40 and engage a locking feature of the nut, such as a nylon ring. After the nut 40 has been threaded onto the threads of the eye hook 26, the nut 40 may retain the end of the eye hook 26 within the second coupler 30.

The protrusion 58 of the first coupler 28 may then be inserted into the main portion 70 of the central aperture 66 of the second coupler 30. The laterally extending apertures 62 and 74 of the first and second couplers 28 and 30 may then be aligned and the pin 32 may be inserted into the laterally extending apertures 62 and 74, locking the first coupler 28 to the second coupler 30. For example, a spring pin may be utilized as the pin 32.

After the cable end assembly 20 has been assembled, the cable end assembly 20 may be coupled to another component of the exercise device 10. For example, the eye hook 26 of the cable end assembly 20 may be coupled to a handle 18 by a fastener, such as by one or more of a hook, a clevis, a split link, and a bolt. In some embodiments (not shown) the eye hook 26 of the cable end assembly 20 may be coupled to the weight stack 14 by a fastener, such as by one or more of a hook, a clevis, a split link, and a bolt.

INDUSTRIAL APPLICABILITY

Many exercise machines include one or more cables that are coupled to an adjustable weight source, such as a stack of weights. Another end of the cable may be coupled to a component with which a user engages with to exercise, such as a handle. Accordingly, the cable may provide resistance force to a user during exercise by transferring force from the adjustable weight source. Typically, to attach an end of the cable to another component of the exercise machine a loop is made in the cable and a sleeve is crimped over the free end and the adjacent portion of cable.

Significant weight loads may be utilized while exercising. Accordingly, the cable may repeatedly carry large loads. While cables utilized in exercise machines may be sized to handle these loading conditions, often the crimped sleeve will fail at a load below which the cable would be expected to fail. Such a failure may render the exercise machine useless for its intended purpose.

As shown in FIG. 1, an exercise machine may comprise a frame, an adjustable weight source, such as a weight stack assembly, a cable, and a component for engagement by a user, such as a handle.

Referring now to FIG. 2, the cable end assembly may include a coupler assembly, a cable end, and an eye hook. The coupler assembly may comprise a first coupler connected to a second coupler joined together by a pin. The cable end may have a fitting attached to an end, the fitting having an enlarged portion with a cross-sectional size larger than a cross-sectional size of the cable. The enlarged portion of the fitting may be retained within a recess of the first coupler. The eye hook may be rotatably coupled to the second coupler by a nut. Additionally, a spacer may be located between the nut and the second coupler.

The cable end assembly may provide relative rotation between the eye hook and the cable, thus allowing a user to rotate an attached handle while exercising without applying a corresponding torque to the cable. This may allow a user to perform exercise orientations that might not be possible using conventional cable end assemblies resulting in improved strength and flexibility. Additionally, the cable end assembly, including the fitting attached to the end of the cable, may have a strength that is greater than the strength of the cable. Accordingly, the cable end assembly may provide a safe and reliable connection that will not unexpectedly fail.

The cable may be a braided stainless steel cable and may include a polymer coating. A length of the polymer coating at the end of the cable may be removed to facilitate insertion of the end of the cable into an opening of the fitting. A region of the fitting adjacent the enlarged end portion may then be swaged by applying external pressure via a swaging die and the fitting may be permanently coupled to the end of the cable.

The first coupler may comprise a central aperture having a first longitudinal region and a second longitudinal region. The first longitudinal region may have a diameter that is larger than the cross-sectional size of the enlarged portion of the fitting attached to the end of the cable and the second longitudinal region may have a diameter that is smaller than the cross-sectional size of the enlarged portion of the fitting. A dished shoulder may be defined at the transition between the first longitudinal region and the second longitudinal region, the dished shoulder having a shape corresponding to an outer surface of the enlarged portion of the fitting.

The first coupler may include a protrusion having an outer diameter that is smaller than the outer diameter of a base portion of the first coupler. The first longitudinal region of the central aperture may extend through the protrusion, and the second longitudinal region may extend through the base of the first coupler. Additionally, a laterally extending aperture oriented generally perpendicular to the central aperture may extend through the protrusion of the first coupler.

The first coupler may further comprise a slot extending to the central aperture, the slot may have a width that is wider than the width of the cable and narrower than the than the cross-sectional size of the enlarged portion of the fitting attached to the end of the cable. Accordingly, the cable may be inserted into the central aperture of the first coupler via the slot such that the enlarged portion of the fitting is positioned proximate to the protrusion, and thus the first longitudinal region of the central aperture. The enlarged portion of the fitting may then be withdrawn into a recess defined by the first longitudinal region and the dished shoulder of the central aperture. As the second longitudinal region of the central aperture is sized smaller than the enlarged portion of the fitting, the enlarged portion of the fitting may be secured against the dished shoulder and prevented from further movement through the central aperture of the first coupler.

The second coupler may comprise a central aperture comprising an end portion having a diameter larger than an outer diameter of a threaded end of the eye hook and smaller than an outer diameter of the nut. The main portion of the central aperture may be sized to accommodate the nut therein and may be sized to correspond to the outer diameter of the protrusion of the first coupler.

Two openings may be machined through an outer wall of the second coupler, extending to the main portion of the central aperture. The two openings may be positioned and configured to facilitate the insertion of a tool, such as an open end wrench or pliers, to selectively allow or prevent the nut from rotating relative to the second coupler when the nut is located therein. Additionally, a laterally extending aperture oriented generally perpendicular to the central aperture may extend through the second coupler.

Each of the first coupler and second coupler may be comprised of a metal material, for example each may be machined from a stainless steel bar stock.

An annular space may be inserted into the main portion of the central aperture of the second coupler and positioned adjacent to the end portion. The annular spacer may be comprised of a polymer material and may be sized such that when positioned within the second coupler, adjacent to the end portion, a surface of the annular spacer may be located adjacent to each of the two openings. The polymer material may be selected so that the surface of the annular spacer, which is located between the nut and the second coupler, may act as a bearing surface, facilitating the rotation of the nut relative to the second coupler.

After insertion of the annular spacer into the second coupler, the nut may be positioned within the main portion of the central aperture, adjacent to the annular spacer. A tool, such as an open end wrench or pliers, may be inserted into the two openings in the second coupler adjacent to outer surfaces of the nut to prevent the nut from rotating relative to the second coupler. The threaded end of the eye hook may then be inserted through the end portion of the central aperture and threaded into corresponding threads of the nut. The nut may be a lock nut, such a nylock nut, and the threaded end of the eye hook may be threaded through the nut and engage a locking feature of the nut, such as a nylon ring. After the nut has been threaded onto the threads of the eye hook, the nut may retain the end of the eye hook within the second coupler.

The protrusion of the first coupler may then be inserted into the main portion of the central aperture of the second coupler. The laterally extending apertures of the first and second couplers may then be aligned and the pin may be inserted into the laterally extending apertures, locking the first coupler to the second coupler. For example, a spring pin may be utilized. In further embodiments, the pin may be another type of pin, such as one of a cotter pin, a split pin, a clevis, a screw, and a bolt.

After the cable end assembly has been assembled, the cable end assembly may be coupled to another component of the exercise device. For example, an eye hook of a first cable end assembly located on the first end of the cable may be coupled to a weight stack by a fastener, such as by one or more of a hook, a clevis, a split link, and a bolt. Likewise, an eye hook of a second cable end assembly located on the second end of the cable may be coupled to a handle by a fastener, such as by one or more of a hook, a clevis, a split link, and a bolt.

What is claimed is:

1. A cable end assembly for an exercise machine, the cable end assembly comprising:

a coupler assembly comprising a first coupler connected to a second coupler;

a cable having a cable end including a fitting attached to the cable end, the fitting having an enlarged portion with a cross-sectional size larger than a cross-sectional size of the cable, the enlarged portion retained within a recess of the first coupler and secured against a shoulder of the first recess; and an eye hook rotatably coupled to the second coupler.

2. The cable end assembly of claim 1, wherein the fitting is attached to the end of the cable end by a swaged region.

3. The cable end assembly of claim 1, further comprising a pin inserted through an aperture of the first coupler and an aperture of the second coupler to lock the first coupler to the second coupler.

4. The cable end assembly of claim 3, wherein the pin comprises a spring pin.

5. The cable end assembly of claim 1, further comprising a nut threaded to an end of the eye hook to retain the eye hook within the second coupler.

6. The cable end assembly of claim 5, wherein the nut comprises a lock nut.

7. The cable end assembly of claim 5, further comprising an annular spacer positioned between the nut and the second coupler.

8. The cable end assembly of claim 5, wherein the second coupler comprises two openings positioned and configured to facilitate the insertion of a tool to selectively allow or prevent the nut from rotating relative to the second coupler.

9. The cable end assembly of claim 1, wherein the first coupler comprises a protrusion sized and configured to fit within a recess of the second coupler.

10. The cable end assembly of claim 1, wherein the first coupler comprises a central aperture having a first longitudinal region and a second longitudinal region, the first longitudinal region having a diameter that is larger than the cross-sectional size of the enlarged portion of the fitting attached to the cable end and the second longitudinal region having a diameter that is smaller than the cross-sectional size of the enlarged portion of the fitting.

11. The cable end assembly of claim 10, wherein the first coupler further comprises a slot extending to the central aperture, the slot having a width that is wider than the width of the cable end and narrower than the cross-sectional size of the enlarged portion of the fitting attached to the end of the cable end.

12. The cable end assembly of claim 1, further comprising a handle coupled to the eye hook.

13. The cable end assembly of claim 1, further comprising a weight stack coupled to the eye hook.

14. A method of manufacturing a cable end assembly for an exercise machine, the method comprising:

attaching a fitting having an enlarged portion with a cross-sectional size larger than a cross-sectional size of a cable, to an end of the cable;

inserting the fitting into a recess of a first coupler;

rotatably coupling an eye hook to a second coupler; and connecting the first coupler to the second coupler.

15. The method of claim 14, wherein rotatably coupling the eye hook to the second coupler comprises inserting an end of the eye hook through an aperture and threading a nut onto the end of the eye hook.

16. The method of claim 15, further comprising positioning a spacer within the second coupler between the nut and the second coupler.

17. The method of claim 15, wherein threading the nut onto the end of the eye hook comprises inserting a tool into two openings within the second coupler to prevent the nut from rotating relative to the second coupler and rotating the eye hook relative to the second coupler and the nut.

18. The method of claim 14, wherein connecting the first coupler to the second coupler comprises inserting a pin through an aperture in the first coupler and through an aperture in the second coupler.

19. The method of claim 14, wherein attaching the fitting to the end of the cable comprises swaging the fitting to the end of the cable.

20. An exercise machine comprising:

a weight stack;

a cable connected to the weight stack;

a cable end assembly comprising:

a coupler assembly comprising a first coupler connected to a second coupler;

a fitting attached to an end of the cable, the fitting having an enlarged portion with a cross-sectional size larger than a cross-sectional size of the cable, the enlarged portion retained within a recess of the first coupler and secured against a shoulder of the first recess; and an eye hook rotatably coupled to the second coupler.

* * * * *